US005331723A

United States Patent [19]

Mathieu

[11] Patent Number: 5,331,723

[45] Date of Patent: Jul. 26, 1994

[54] FOLD-OUT CLASP

[75] Inventor: Francois Mathieu, Saint-Claude, France

[73] Assignee: Maier S.A., Saint Claude, France

[21] Appl. No.: 960,463

[22] PCT Filed: Apr. 1, 1992

[86] PCT No.: PCT/FR92/00291

§ 371 Date: Feb. 18, 1993

§ 102(e) Date: Feb. 18, 1993

[87] PCT Pub. No.: WO92/18029

PCT Pub. Date: Oct. 29, 1992

[30] Foreign Application Priority Data

Apr. 19, 1991 [FR] France ..... 91 05084

[51] Int. Cl.[5] ..... A44C 5/00

[52] U.S. Cl. ..... 24/71 J; 24/69 J; 24/265 WS

[58] Field of Search ..... 24/71 J, 69 J, 68 J, 24/70 J, 265 WS, 600.9, 615, 616

[56] References Cited

U.S. PATENT DOCUMENTS

| | | | |
|---|---|---|---|
| 1,771,249 | 7/1930 | Domler | 24/71 J |
| 1,839,788 | 1/1932 | Hogberg | 24/71 J |
| 1,997,723 | 4/1935 | Franklin, Jr. | 24/71 J |
| 2,480,923 | 9/1949 | Hatchette | 24/615 |
| 2,532,840 | 12/1950 | Gaun | 24/71 J |

FOREIGN PATENT DOCUMENTS

| | | | |
|---|---|---|---|
| 0208168 | 1/1987 | European Pat. Off. | 24/265 WS |
| 1170556 | 1/1959 | France | 24/69 J |
| 0649205 | 5/1985 | Switzerland | 24/71 J |
| 0661609 | 11/1951 | United Kingdom | 24/71 J |

*Primary Examiner*—Victor N. Sakran
*Attorney, Agent, or Firm*—Henderson & Sturm

[57] ABSTRACT

A folding clasp for a bracelet, including a shank comprising two parallel side members each of which have a first end and a second end, wherein the first end of one parallel side member is connected to a first end of another parallel side member and wherein the second end of one parallel side member is connected to the second end of the other parallel side member, and at least one transverse element interconnecting each of the parallel side members; a first arm having one end articulated at the first end of each of the parallel side members; and another arm articulated at the second end of each of the parallel side members, so that the first arm and the other arm are adapted fold down and lock in the shank on a transverse element, wherein each of the first arm and the other arm includes a head, having on a front face a concavity for compressing on the transverse element and on a bottom face a recess located behind the concavity, for receiving a bracelet end and for locking the arm inside the shank.

20 Claims, 2 Drawing Sheets

FOLD-OUT CLASP

The present invention relates to a folding clasp for a bracelet of the type comprising a centre shank formed by two parallel side members connected at their ends. On these ends are articulated folding arms which fold down and lock in the shank.

For many years, attempts have been made to create bracelet clasps which, for aesthetic reasons, can be concealed when the bracelet is in the closed position. To achieve this aim, consisting of hiding the clasp when the bracelet is closed, clasps with a shank and folding arms have been proposed, on which the arms fold down into the shank to avoid any projection, which is considered unsightly.

The problem is to lock these folding arms correctly in the closed position, without anything being seen from the outside, and various technical solutions have been adopted.

A first solution consists of locking the folding arms laterally in the shank, a solution which is described for example in the disclosures in U.S. Pat. No. 1,839,788, FR 537 072 and EP 0 115 740. The major drawback of this solution is that, in order to have a closure which is both secure and openable with sufficient ease, the lateral profiles of the folding arms and side members forming the shank have to be manufactured with a great deal of care, making the operation expensive.

A second solution consists of locking the folding arms at the end, and in this respect the disclosure in FR 2 619 292 will be cited, in which each folding arm is locked, by means of its latch-shaped head, in a corresponding rod connecting the side members.

The clasp described in the disclosure in CH 633 698 will also be cited, in which the arms are locked on a single central member.

The invention repeats the simplicity of the technical solutions described in the disclosures FR 2 619 292 and CH 633 698, whilst eliminating from them the drawbacks which make them rather impractical.

According to the invention, in fact, a folding clasp for a bracelet is disclosed, comprising a central shank formed by two parallel side members connected at their ends. On these are articulated folding arms folding down and locking in the shank on a member connecting the two side members transversely. Each arm has a head which both receives a bracelet end and ensures locking inside the shank. These heads each have on their front face a concavity which, when locking takes place, bears in compression on the transverse member and thus locks the folding arms. The locking heads each have, on their bottom face, a transverse recess located behind the concavity.

In a first embodiment, there is only one transverse locking member. It alone receives and locks the two heads closed.

In a second embodiment, each head has its own transverse locking member, these for example being located side by side.

Preferably the locking member or members are rods and, preferably also, the arms, each with its respective head, are made in a single piece.

Particularly advantageously, the transverse recess provided on the bottom face of each of the folding arms is a groove, U-shaped or with a square or rectangular shape, and its width is modifiable.

It will be observed first of all that, compared with the solution adopted in the disclosure FR 2 619 292, locking takes place in compression on the folding arms rather than in extension. The mechanism is more robust and simpler and is more tolerant to deviations from manufacturing specifications.

Compared with the solution in the disclosure CH 633 698, the presence of a central recess on each of the folding arms gives a latch shape to the locking heads thus giving the necessary flexibility allowing easy locking and unlocking, which appears to be completely impractical with solid components.

The fact also that the locking heads can, if desired, be produced in a single piece (monobloc) with their arms results in great strength of the whole, which is not the case with the clasp in the disclosure CH 633 698, in which, according to the figures, the head is in two parts connected together. The assembly described in this disclosure therefore has great fragility under repeated loadings.

Moreover, the fact that the heads are made in a single piece makes it possible to produce relatively deep recesses on their bottom faces, leaving sufficiently little material at the junction between them and their respective arms in order to give geometrically a supplementary flexibility, being added to the flexibility inherent in the latch shape of the heads.

Finally it will be noted that, since the width of the transverse recess can be modified, for example by means of a screwdriver or the tip of a knife, it is thus possible to compensate for any fatigue which may be suffered over time by the latch on the head, that is to say the part of the head between the concavity and the transverse recess. In this way it is ensured that the locking of the clasp will never be defective since, if this locking were to become progressively more slack, it would suffice to open the recess very slightly in order to compensate for this weakness.

The invention will be understood better with reference to the accompanying drawings given by way of non-limiting examples.

Figure 1:
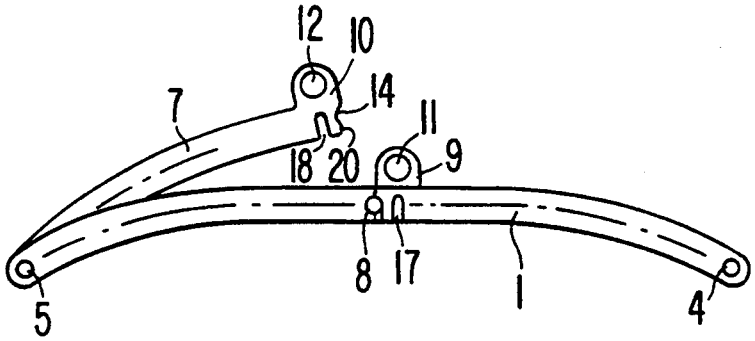
FIG. 1 is a side view, in cross section, of the clasp of the invention in the partially folded position, in a first embodiment.
Figure 2:
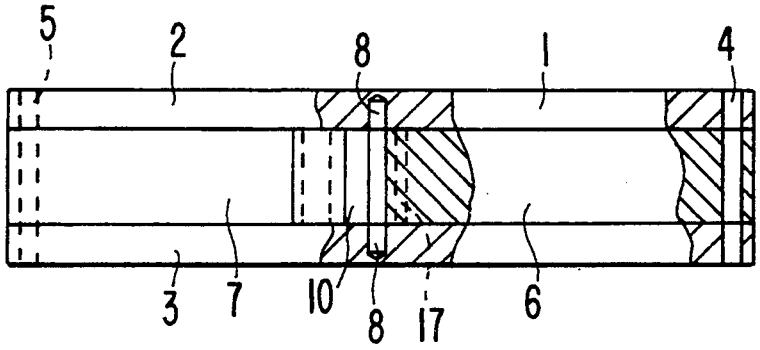
FIG. 2 is a plan view of the same clasp, the side members and folding arms of which are illustrated partially in cross section.
Figure 3:
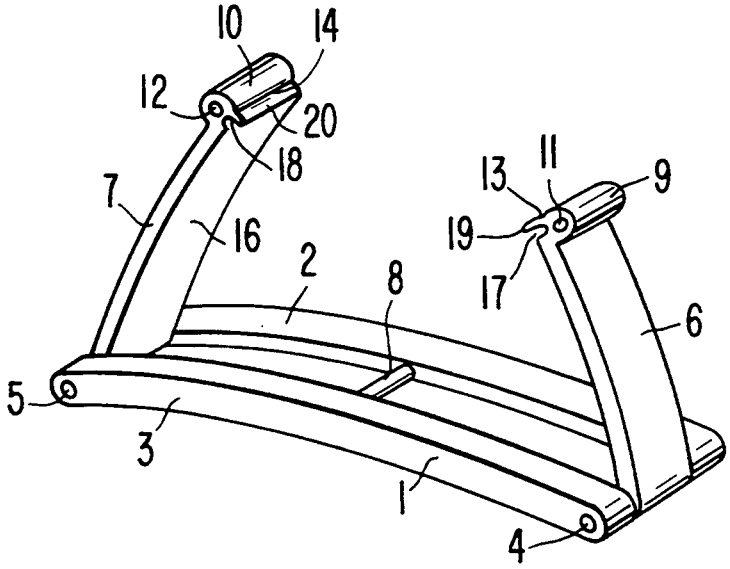
FIG. 3 is a view in perspective of this same clasp in the open or unfolded position.

As can be seen in FIGS. 1 to 3, the clasp consists of a shank 1 formed by two parallel side members 2, 3, which are connected at their ends by two pins 4, 5 on which two folding arms 6, 7 are articulated.

These folding arms 6, 7 fold towards the centre and lock in the shank 1 around a single member 8 connecting the two side members 2, 3 transversely. As illustrated in the figures, this member 8 is a rod or pin disposed at right angles to the side members 2, 3 and set in them. It is placed in a central position in the shank 1. In this way, the two folding arms 6, 7 are of the same length.

In one variant, not shown, the rod is not in a central position but is offset with respect to the transverse symmetry axis of the shank 1, in which case the two folding arms 6, 7 are of unequal lengths.

In another variant, not shown, independent of the first, the rod serving as a locking member 8 is sheathed in a metal tube which covers it and which can rotate freely about it; as an alternative, the metal sheath can be replaced with a plastic sheath, for example made from Teflon (registered trade mark) either in the form of a sheath properly speaking or in the form of an adherent deposit. Teflon is a trademark for tetrafluoroethylene (TFE) fluorcarbon polymers, and fluorinated ethylene-propylene (FEP) resins.

The folding arms 6, 7 each comprise heads 9, 10 respectively, which are in line with and in a single piece with their respective arms 6, 7. The two arms with their heads are therefore made in a single piece.

Each head 9, 10 has a bulge in which are provided fixing means enabling it to be connected to one end of the bracelet; likewise for the other head. These fixing means are represented diagrammatically in the figures by the pins 11, 12, the corresponding ends not being illustrated for the sake of clarity of the figures.

The heads 9, 10 have on their front faces, that is to say on the faces which will come into contact with the locking member 8, concavities 13 and 14 respectively, the depth and curvature of which are matched to the shape of the member 8, which, as indicated above, can be a cylindrical, ovoid or again polygonal rod 8.

On the bottom faces 15, 16 of the arms, at the heads 9, 10, are provided recesses or grooves 17 and 18 respectively, so as to give the heads 9, 10 the shape of latches 19, 20 respectively, between the concavities 13 and 14 respectively and the recesses 17 and 18 respectively. The depth of the recesses 17, 18 is such that it allows a narrowing at the junction between the arm and corresponding head, so as to give the whole a certain flexibility. However, the major part of the flexibility necessary for closing and locking, and unlocking and opening, results from the elasticity of the latches 19 and 20 respectively, due to the interaction between the concavities 13, 14 and recesses 17, 18.

Figure 4:
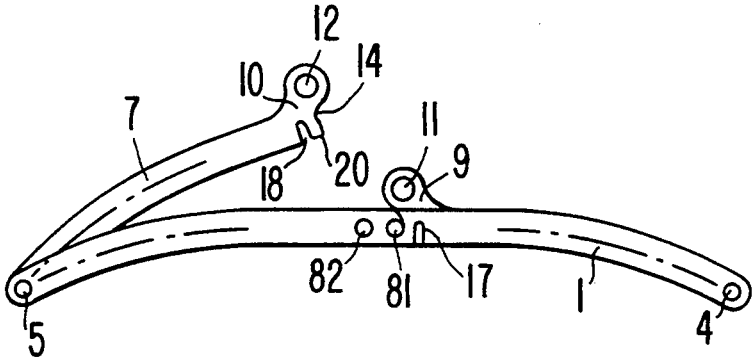
FIG. 4 is a side view, in cross section, of the clasp of the invention in the partially folded position, in a second embodiment.
Figure 5:
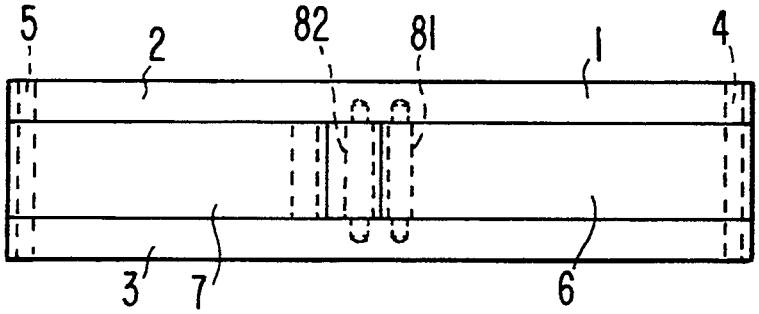
FIG. 5 is a plan view of the clasp of FIG. 4, in the closed position, that is to say fully folded.
Figure 6:
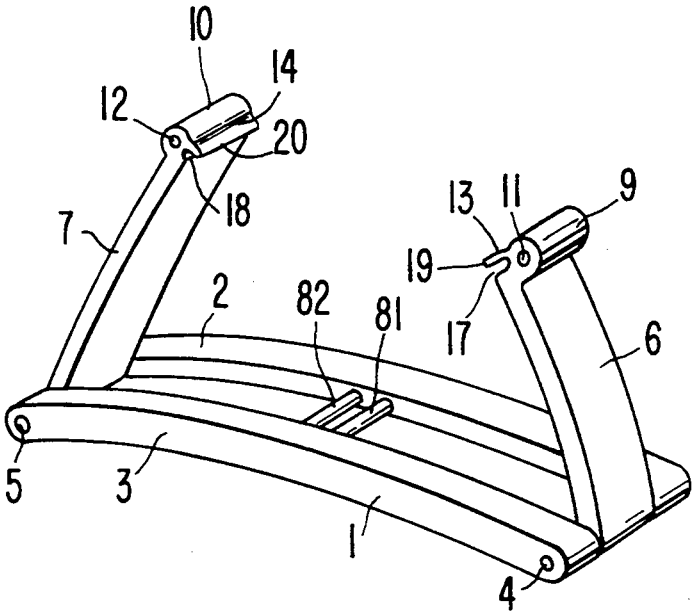
FIG. 6 is a view in perspective of the same clasp of FIG. 4, in the open or unfolded position.

The clasp in FIGS. 4 to 6 is distinguished from the clasp in FIGS. 1 to 3 in that the single locking member 8 is replaced with two identical devices 81, 82 placed side by side, at right angles to the side members 2, 3 and symmetrically with respect to the middle of the clasp (they could also be offset with respect to the centre, if the arms are of unequal length). Each head 9, 10 locks onto its own transverse member 81 and 82 respectively, a rod or pin for example.

It will be observed that the concavities 13, 14 produced in the heads 9, 10 are hollowed out to a greater extent than in the embodiment in FIGS. 1 to 3. In both cases, the objective aimed at, for reasons of a technical and aesthetic nature, is that, once the clasp is closed, the top visible parts of the heads just come into contact with each other or are as close as possible. The shape and depth of the concavities are designed accordingly.

Locking of the bracelet is an operation of great simplicity since it suffices to fold the folding arms 6, 7 down into the shank 1 and to press lightly for the latches, by deformation of these latches 19, 20 on the heads 9, 10, to move past the resistance on the locking member 8 or members 81, 82, and lock onto their concavity 13, 14. For unlocking, the reverse operation is carried out just as easily.

It will be appreciated that the locking and unlocking operations are made particularly easy and can be repeated many times without any risk of breaking, since the necessary flexibility is catered for by the deformation of the latches 19, 20 when the member 8 or members 81, 82 pass, some of which flexibility is catered for by the head 9, 10 as a whole, because of the existence of the recesses 17, 18 in the thickness of the arms 6, 7.

An enormous advantage of the clasp according to the invention is that, if the material making up the latches 19, 20 happens to deform slightly under repeated loadings, no longer allowing satisfactory locking, it will suffice to compensate for this deformation by widening the recesses 17, 18, even imperceptibly, which can be done very easily, simply with the tip of a screwdriver or knife.

To give an idea, without the values given below being in any way limitative, it is possible to adopt, for a thickness of folding arms of between 1.60 and 2.10 mm, a depth of recess of between 1.00 and 1.60 mm, with a thickness of latch between the recess and the bottom of the concavity of between 0.40 and 0.80 mm. These values are typical values which are well suited to the materials normally used for producing clasps, such as metals, for example stainless steel, brass, nickel silver or certain plastics.

I claim:

1. A folding clasp for a bracelet, said folding clasp comprising a shank comprising two parallel side members, each of said parallel side members having a first end and a second end wherein the first end of one parallel side member is connected to a first end of another parallel side member and wherein the second end of one parallel side member is connected to the second end of another parallel side member, and at least one transverse element interconnecting each of said parallel side members; a first arm having one end articulated at said first end of each of said parallel side members; and another arm articulated at said second end of each of said parallel side members, said first arm and said another arm folding down and locking in said shank on said at least one transverse element, wherein said first arm and said another arm each comprises a head for receiving a bracelet end and locking the arm inside said shank, wherein each said head comprises on a front face a concavity for compressing on said at least one transverse element and locking the arm, and wherein each said head on a bottom face comprises a recess located behind said concavity.

2. The folding clasp according to claim 1, wherein said at least one transverse element comprises a rod.

3. The folding clasp of claim 2, wherein said rod comprises a cross section having a shape selected from the group consisting of a circular shape, an ovoid shape, and a polygonal shape.

4. The folding clasp of claim 3, wherein said concavity in said front face of said head of said arm comprises dimensions to complement said shape so as to be adapted to mate with said rod.

5. The folding clasp according to claim 2, wherein said rod is covered with material.

6. The folding clasp of claim 5, wherein said material is selected from the group consisting of metal materials and plastic materials.

7. The folding clasp of claim 6, wherein said material comprises a sheath adapted to rotate about said rod.

8. The folding clasp of claim 7, wherein said material comprises a plastic material.

9. The folding clasp of claim 8, wherein said plastic material comprises a member selected from the group consisting of fluorethylene fluorocarbon polymers and fluorinated ethylene-propylene resins.

10. The folding clasp of claim 5, wherein said material comprises an adherent coating deposited on said rod.

11. The folding clasp according to claim 1, wherein each said head is integral with each arm.

12. The folding clasp of claim 1, wherein said at least one transverse element comprises a locking member.

13. The folding clasp according to claim 12, wherein said at least one transverse element comprises a single cross member.

14. The folding clasp according to claim 12, wherein said at least one transverse element comprises two transverse elements.

15. The folding clasp of claim 14, wherein said two transverse elements comprise a first transverse element substantially adjacent to a second transverse element.

16. The folding clasp of claim 15, wherein said first transverse element is substantially parallel to said second transverse element.

17. The folding clasp of claim 12, wherein said head comprises a latch formed between said concavity in said front face and said recess in said bottom face, said latch being adapted to cooperate with said locking member when said latch is compressed against said locking member so as to lock said locking member in said concavity.

18. The folding clasp of claim 1, wherein said recess is a transverse recess.

19. The folding clasp according to claim 18, wherein said recess has a width which is adjustable.

20. The folding clasp of claim 1, wherein said first arm has a length substantially the same as a length of said another arm.

* * * * *